United States Patent [19]

Forbes et al.

[11] Patent Number: 4,799,519

[45] Date of Patent: Jan. 24, 1989

[54] WOOD SPLITTER

[76] Inventors: Curtis E. Forbes, N8346 State Highway 73, Randolph, Wis. 53956; Micheal M. Forbes, 406 W. James St., Columbus, Wis. 53925; William L. Forbes, 60 E. Cedar St., Platville, Wis. 53818

[21] Appl. No.: 195,799

[22] Filed: May 19, 1988

[51] Int. Cl.[4] ..... B27L 7/00

[52] U.S. Cl. ..... 144/366; 144/193 A

[58] Field of Search ..... 144/3 K, 193 R, 193 A, 144/366

[56] References Cited

U.S. PATENT DOCUMENTS

| | | | |
|---|---|---|---|
| 3,974,867 | 8/1976 | Butas, Jr. | 144/193 A |
| 3,995,672 | 12/1976 | Binninger | 144/193 A |
| 4,596,279 | 6/1986 | Taylor | 144/193 A |

FOREIGN PATENT DOCUMENTS

| | | | |
|---|---|---|---|
| 233927 | 5/1961 | Australia | 144/193 A |

*Primary Examiner*—W. Donald Bray

*Attorney, Agent, or Firm*—Fuller, Puerner & Hohenfeldt

[57] ABSTRACT

A wood splitting machine has a carriage and a blade assembly mounted to slidable members that are driven slidably on stationary guide members. A stop member is mounted over the carriage in spaced relationship to the blade assembly. The blade assembly comprises a transversely extending blade for making a horizontal cut in wood lying on the carriage between the stop member and the blade assembly. A plurality of laterally spaced apart vertically oriented blades hang from the blade that cuts in a horizontal plane. Hydraulic actuators advance the blade assembly through the wood lying on the carriage. The carriage translates out from under the wood resting on the carriage so that when the blades have completely passed through the length of the wood, the carriage has departed from under in which case the wood pieces that are split by the horizontal and vertical blades are free to drop down. The vertical blades are pivotally mounted in the horizontal blade so that the vertical blades can yield laterally and allow the pieces of wood to separate without binding on the blades.

8 Claims, 2 Drawing Sheets

10
11
13
16
17
18
19
20
21
22
23
24
29
37
44
47
48
49
51

WOOD SPLITTER

BACKGROUND OF THE INVENTION

This application is a substitute for application Ser. No. 06/903,591, filed Sept. 4, 1986, now abandoned.

The invention disclosed herein pertains to a machine that is most commonly used for splitting lengths of logs into so-called firewood although the machine can be used to split wood into pieces for other uses too.

The most widely used wood splitting machines have means for holding one end of a short piece of log against a stop while a blade is advanced through the log from its other end under the influence of a hydraulic work cylinder or actuator. One of the problems with this popular type of wood splitter is that the wood derived from a single large diameter log has unsuitably large width when the log has been cut just one time. This means that the two pieces resulting from splitting the log once must be put into the machine again for subdividing the pieces into smaller pieces which are more suitable for burning in a fireplace or stove. The repeated handling of the wood results in labor costs which are unduly high and this must necessarily result in the consumer paying a high price for the wood.

SUMMARY OF THE INVENTION

An objective of the present invention is to provide a fully automatic wood splitting machine that can be loaded with several logs of different sizes and which subdivides the logs into wood pieces that are most appropriate for burning in a fireplace or stove.

Briefly stated, the new wood splitter is operated with hydraulic work cylinders. The illustrated embodiment of the machine comprises a pair of laterally spaced apart longitudinally extending stationary guide members or tracks. There are support members mounted on the guide members for slidably advancing and retracting in opposite longitudinal directions. Blade support means are mounted to the support member for moving with the members. A blade assembly is mounted to the support means and it includes a primary blade having a laterally extending cutting edge for splitting a log or block of wood in a horizontal plane. The blade assembly includes a plurality of laterally spaced apart secondary blades which are located under the primary horizontal blade. The secondary blades extend vertically so that when the blade assembly is advanced into the end of a log, a slab will result from a horizontal cut being taken and concurrently, the vertical secondary blades will divide the slab into separate pieces.

A carriage is mounted to the bi-directionally movable support members which slide on the stationary guide members in addition to the blade assembly which is mounted to the support members. The carriage provides a plate constituting the bottom of a wood splitting chamber. The trailing end of the plate is right under the cutting edge of the horizontal blade and the leading end of the plate is faced in the longitudinal direction away from the blade assembly. There is a fixed stop member mounted over the leading end of the plate. A quantity of log sections having a total width equal to the width of the plate can be deposited on the plate of the carriage, that is, in the splitting chamber with corresponding one ends abutting the stop member and with the opposite corresponding ends facing toward the blades. Then the horizontal primary blade and the multiple vertical blades are advanced into the wood as a result of the slidable support members being pushed by the hydraulic work cylinders. As the blades advance into the log section, the carriage plate concurrently begins to slide out from under the log section which is then mostly suspended by being pressed against the stop by the force of the blades. The cutting edges of the blades travel sufficiently to enter cavities in the stop member to assure that the blades cut through the entire length of the log section. By this time, the carriage plate is moved out from under the one or more log sections in the splitting chamber and the pieces of the logs below the horizontal blade are free to drop down for being conveyed away or otherwise carried away. The top part of any log section above the horizontal blade just lets the horizontal blade slide under it. When the blade assembly is retracted, the upper part or slab of the log drops down to the carriage plate and it can be cut into pieces by the horizontal and vertical blades if the slab is thin enough and if it is not, only the vertical blades will subdivide the slab into pieces having widths substantially equal to the distance between the vertical secondary blades.

How the foregoing and other more specific objectives and features of the invention are achieved will now be described in greater detail in reference to the accompanying drawings.

DESCRIPTION OF A PREFERRED EMBODIMENT

Figures 1, 2:
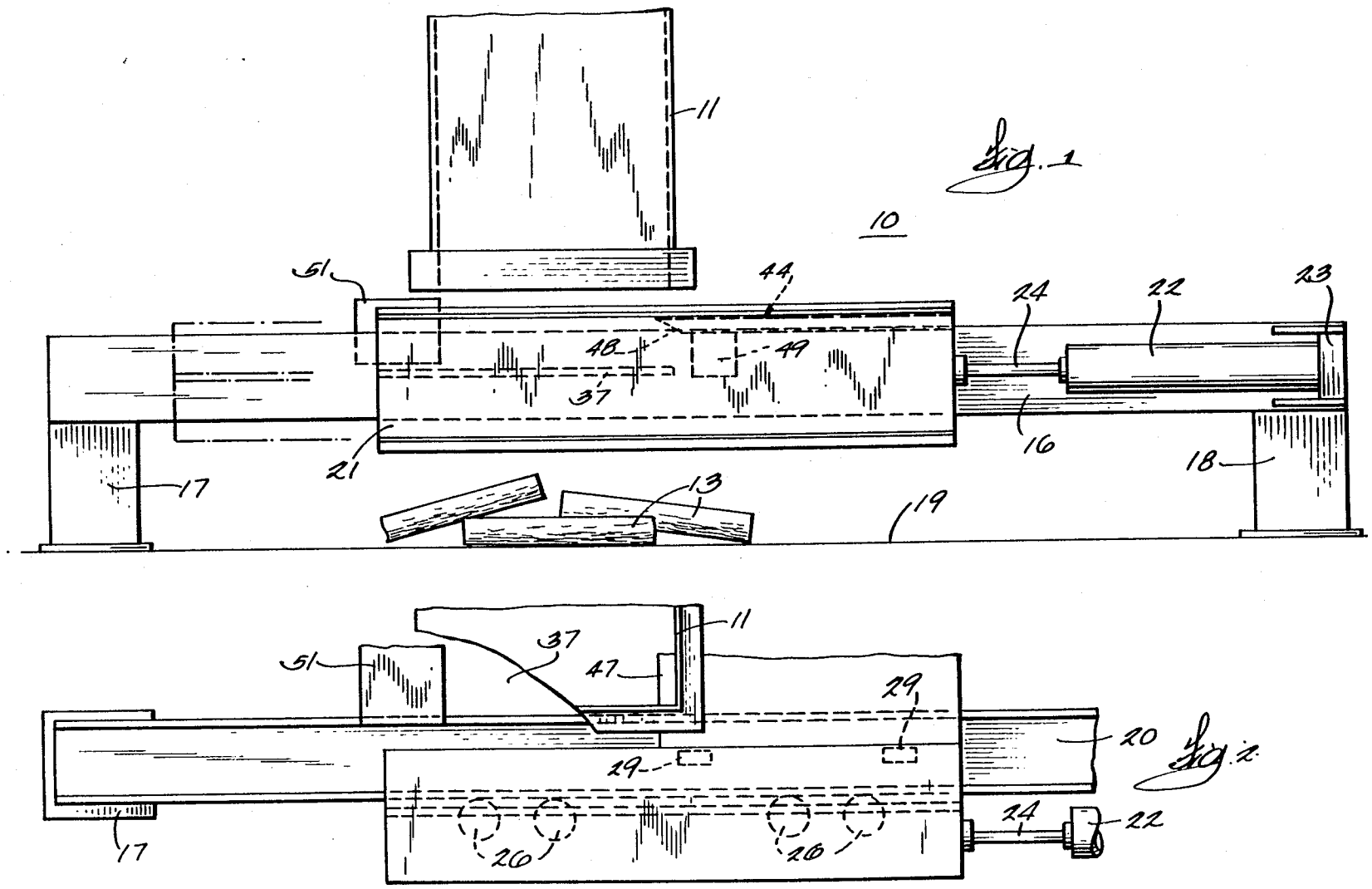
FIG. 1 is a largely schematic side elevational view, with parts broken away, of the new wood block or log splitting machine.
FIG. 2 is a top or partial plan view of the wood splitting machine taken on a line corresponding with 2—2 in FIG. 1.
Figure 4:
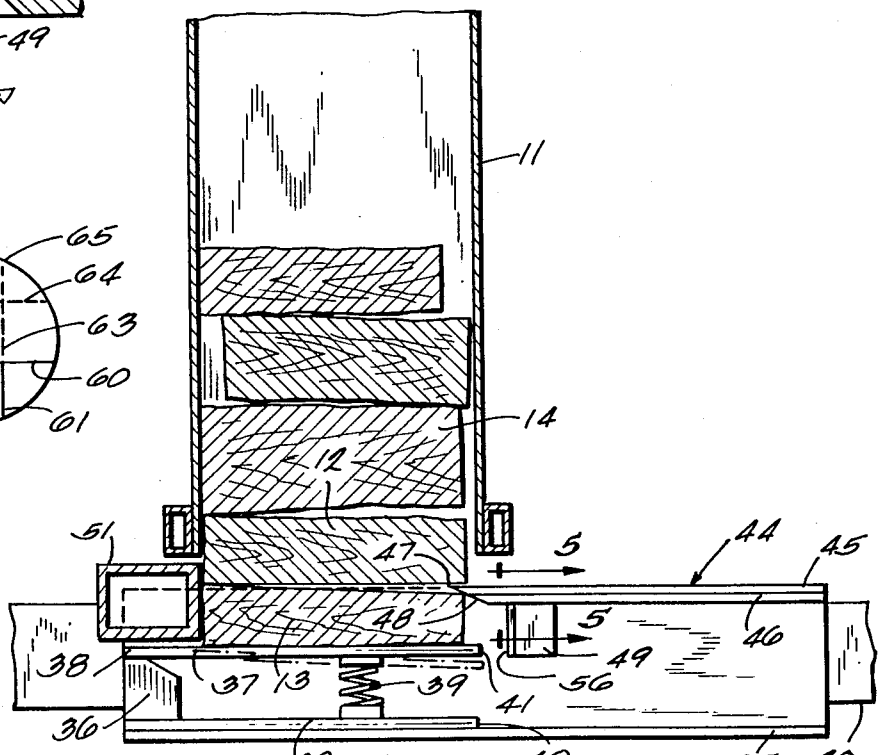
FIG. 4 is a side elevational view, partially in section, wherein the parts have the same orientation as in FIG. 1, but with parts broken away to show how the log sections to be split drop into the splitting chamber from a hopper where they are engaged by the leading edge of a horizontal cutting blade to initiate cutting while the opposite ends of the log sections are pushed up against a stop.

In FIG. 1, the new wood splitting machine is generally designated by the reference numeral 10. A hopper 11 is located above the machine and it has an open bottom for allowing wood or log sections which are loaded into the hopper to drop into the machine for being split. FIG. 4 shows some wood blocks or log sections in hopper 11. The one log section that is currently being split has its upper half marked 12 and its lower half marked 13. Other log sections such as the one marked 14 are shown in FIG. 4 and FIG. 3 as well.

One of the stationary longitudinally extending guide members 16 comprising the frame of the machine is visible in FIG. 1. This guide member is supported on two pedestals 17 and 18 which are standing on a flat surface 19 which could be the bed of a truck, for example. As can be seen best in FIG. 3 where guide member 16 is shown in section, there is a corresponding stationary longitudinally extending guide member 20 on the other side of the machine. These guide members may be H-beams as shown. Referring to FIGS. 1 and 3 again, there is a longitudinally extending support member 21 supported for sliding bi-directionally on guide member 16 under the influence of a motive means in the form of a hydraulic actuator having the free end of its cylinder is anchored to a frame member 23 of the machine. The piston rod 24 of the hydraulic actuator is coupled to slidable support member 21.

Figure 3:
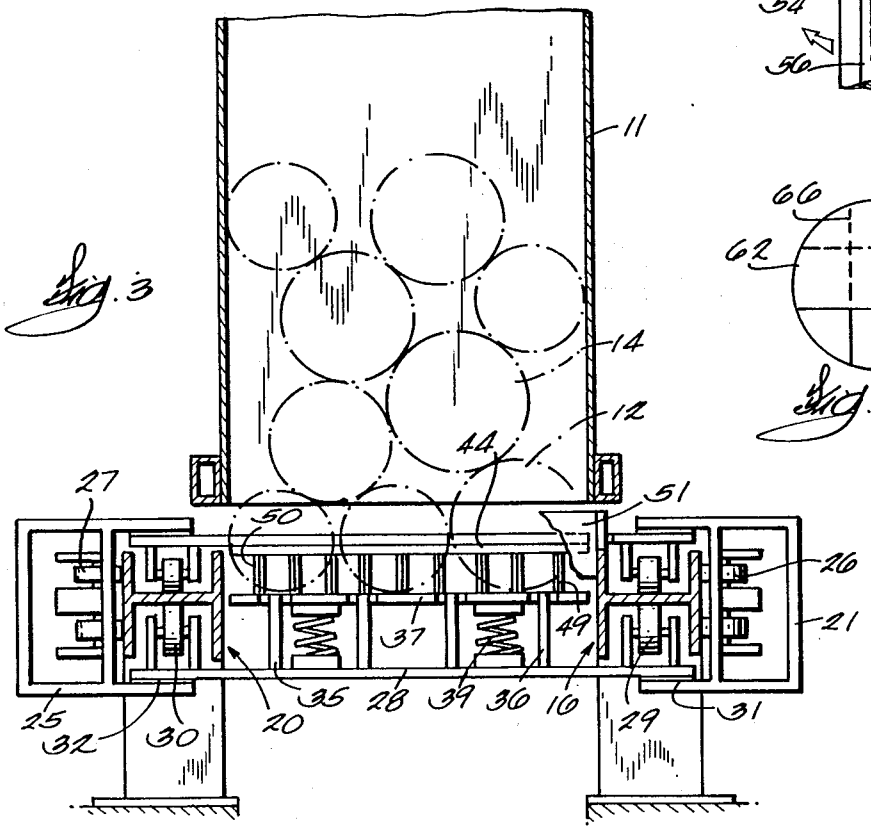
FIG. 3 is a vertical sectional view taken on the plane corresponding to 3—3 in FIG. 1.

As is visible in FIG. 3, there is a corresponding support member 25 on the side opposite of the machine from slidable support member 21. Support member 25 is slidable on longitudinally extending stationary guide member 30. A hydraulic actuator, not shown, corresponding to actuator 22 is coupled to slidable support member 25 to assure that the support members 21 and 25 will move along their guide members 16 and 20, respectively, without having an tendency to get out of alignment. A set of rollers such as the one marked 26 is mounted to support member 21 as shown in FIG. 3 and a similar set of rollers such as the one marked 27 is mounted to the support member 25. The sets of rollers 26 and 27 run on the flanges of H-shaped stationary guide beams 16 and 20 to provide lateral guidance for the support members. As can be seen in FIG. 3, there is a lower plate 28 constituting a part of a carriage. This plate has rollers such as the ones marked 29 and 30 mounted to it for running on the bottom of the webs of the H-shaped guide beams 29 and 30 to prevent the carriage from shifting upwardly. Bottom plate 28 of the carriage is fastened, such as by welding along lines 31 and 32 to the inwardly extending flanges of support members 21 and 25, respectively.

As can be seen most clearly in FIGS. 3 and 4, there are a plurality of upstanding gusset plates, such as those marked 35 and 36, which are fastened to bottom carriage plate 28 by any suitable means such as welding. A top plate 37 of the carriage is pivotally connected to the gussets for pivoting on a laterally extending horizontal axis which is marked 38 in FIG. 4. Top carriage plate 37 is supported on heavy springs such as the one marked 39 which is anchored to the bottom carriage plate 28 and the bottom of top carriage plate 37. Top plate 37 tilts downwardly under some circumstances which will be described subsequently as indicated by the phantom lines in FIG. 4. Note that the trailing end 40 of lower carriage plate 28 terminates directly under the trailing end 41 of upper tiltable carriage plate 37.

There is a blade assembly generally designated by the reference numeral 44 whose profile can be seen in FIG. 4 particularly well. The blade assembly 44 is mounted to support member 25 so that when support member 25 and its counterpart 21, is advanced to the left under the influence of the hydraulic actuators, the blade assembly 44 advances to the left and begins to split a log into several parts as will be explained. The blade assembly is comprised of a primary blade having two layers 45 and 46 which are fastened together. These blades are made of hard steel such as is used in farm implements to disc soil. This composite blade is composed of layers 45 and 46 extends laterally at least across the width of the hopper. As shown in FIG. 4, the leading edge 47 on the top blade layer 45 is sharpened as a knife and the blade is beveled as at 48 in FIG. 4 rearwardly. The angle of the beveled surface with respect to horizontal is preferably about 30°. In FIG. 4 the sharp cutting edge 47 has just begun to enter and split the log section that is resting on top carriage plate 37. There are also a plurality of vertically extending blades such as the one marked 49 in FIGS. 4 and 3. As shown in FIG. 3, in this particular model of the splitting machine, there are nine laterally spaced apart vertically oriented blades. Blade 49 is at one end of the row of blades and blade 50 is at the other end of the row as shown in FIG. 3. Referring to FIG. 4 for the moment, one may see that there is a stop beam 51 spanning laterally across the path of the blades. In FIG. 3 where an end fragment of stop beam 51 is shown, it will be evident that this beam is fastened to stationary guide member 16 at one end and to the other guide member 20 at its other end which is not shown in FIG. 3.

Figure 5:
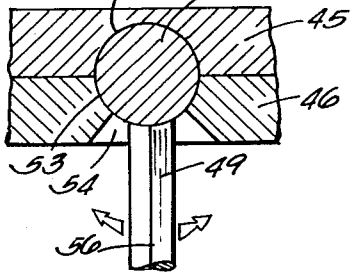
FIG. 5 is a fragmentary sectional view of one of the vertically oriented secondary blades, taken on the line 5—5 of FIG. 4, showing how these blades are provided with a cylindrical element that registers in a cylindrical socket in the primary horizontal blade so that the vertical blades can swivel laterally of the direction in which they are advanced to cut through the log sections and allow the sections to spread open.

FIG. 5 shows a fragmentary vertical section taken through the upper primary horizontal blade layers 45 and 46 and through one of the vertical blades 49, which section corresponds to the lines 5--5 in FIG. 4. FIG. 5 shows how the primary horizontal blade layers have semi-circular grooves 52 and 53 formed in them. Together, grooves 52 and 53 form a cylindrical socket that has a slot 54 on its bottom face. The walls of this slot are angulated as shown. Blade 49 has a cylindrical element 55 fastened to it by suitable means such as welding. Cylinder elements 55 act as shafts rotating in the circular cylinder formed in the blade layers which is for affording the vertical blades an opportunity to swivel laterally as they are being forced endwise through a log section that is resting on tiltable upper plate 37 of the carriage. This allows the pieces of wood to spread out in a natural manner as the vertical blades pass through in which case binding of the blades in the wood is avoided and less power is required to split the wood.

It should be noted in FIG. 4 that the sharpened beveled cutting edges 56 of the vertical or secondary blades 49 are set rearwardly or back from the sharpened edge 47 of the primary horizontal blades comprised of layers 45 and 46 which cause a transverse or horizontal cut to be made in the log section that is deposited on upper tiltable plate 37 of the carriage.

An operating cycle of the machine will now be described in reference to FIG. 4. In FIG. 4 one of several logs that are resting side-by-side on top carriage plate 37 is illustrated as starting to be split into upper and lower parts 12 and 13. This log is interposed between stop member 51 and the leading cutting edge 47 of the blade that cuts in the horizontal plane. The top plate 37 of the carriage constitutes the bottom of a splitting chamber and stop member 51 and cutting edge 47 define its two ends.

Now assume that the hydraulic actuators 22 are activated to advance the blades into the wood in FIG. 4. It will be evident that the horizontal cutting blade starts to split the log into upper and lower slabs 12 and 13 before the vertical blades 49 begin to cut into the end of the log section. Since the blade assembly 44 and the carriage comprised of upper and lower plates 37 and 28 are both mounted to slidable support members 21 and 25, the blade assembly and carriage advance to the left in FIG.

4 together. Thus, as the primary horizontal and secondary vertical cutting blades pass through the log section to split it into an upper slab 12 and a plurality of pieces fitting in between the vertical blades 49 the carriage moves correspondingly out from under the log sections that are being split. The stop member 51 is provided with openings, not visible, to permit the blades to enter the stop member to the extent of about two inches in an actual embodiment of the machine so that complete splitting of the entire length of the log section is assured. During splitting, the log sections simply hang above the level of the top plate 37 of the carriage since the sections are gripped by the blades and frictionally gripped by the stop member 51. Since the trailing ends 40 and 41 of the upper plate 37 and lower plate 28 of the carriage have now departed from under the log sections in the splitting chamber, the log sections that have been split vertically from the lower slab are free to drop down and accumulate as shown in FIG. 1 where the pieces of firewood are marked 13 again.

The log sections may drop down as soon as the carriage is shifted out from under them. When the blade assembly 44 is fully advanced through the stop member 51, the slab 12 constituting the upper part of a log section is resting on the top of the horizontal blade layer 45. When the blade assembly is retracted to the right in FIG. 4, slab 12 drops onto top plate 37 of the carriage and it is ready to be cut by the vertical blades into laterally adjacent pieces.

Figure 6:
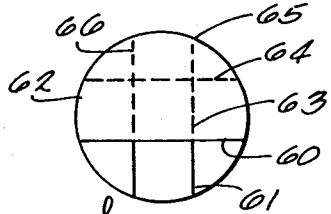
FIG. 6 is a diagram of a circular log which is marked with cutting lines to facilitate explaining how a single log section can be cut into a plurality of pieces having substantially equal width and thicknesses.

The machine is capable of cutting logs of very large diameter into substantially similarly sized pieces. Consider FIG. 6, for example, which shows the end view of a log whose diameter is much greater than the distance between the plane of the horizontal cutting blade and the top plate 37 of the carriage. In a case such as this, the first horizontal cut would be made along the solid line marked 60. The vertical blades would make the cuts designated by the solid vertical lines 61. This would leave a slab 62 resting on top of the horizontal blades 45, 46. When the blade assembly is retracted, the flat face 60 of the slat 62 would land on the top carriage plate 37 and when the blades are advanced again, vertical cuts 63 and a horizontal cut 64 would be made, thus leaving a slab 65 remaining on the top of the horizontal blade. The next advancement or cutting cycle of the blades would make the vertical cuts 66 in the uppermost slab 65 during the next cutting cycle.

Although an embodiment of the invention has been described in detail, such description is intended to be illustrative rather than limiting, for the invention may be variously embodied and is to be limited only by interpretation of the claims which follow.

We claim:

1. A wood splitting machine comprising:

longitudinally extending laterally spaced apart stationary guide members, support members mounted on said guide members for advancing and retracting in opposite longitudinal directions, motive means operative to advance and retract said support members, blade support means mounted to said support members for moving therewith, a blade assembly mounted to said blade support means, said assembly including a primary blade having a laterally extending cutting edge for splitting a wood block in a horizontal plane and a plurality of laterally spaced apart secondary blades having cutting edges extending generally vertically below said primary blade for splitting said wood block vertically, carriage means mounted to said support members such that said carriage means is advanced and retracted jointly with said blade support means in response to operation of said motive means, said carriage means including a generally horizontal plate means having a trailing end adjacent said blade assembly, said plate supporting pieces of wood that are to be split, and stop means fixed over said plate means of said carriage in a position remote from said blade assembly when said assembly is retracted so that a block of wood deposited on said top plate means will be captured between said blade assembly and said stop means when said blade assembly is advanced to split said wood, said carriage being simultaneously advanced to remove the carriage plate from under said wood to allow the split pieces of wood to drop down below said carriage.

2. The wood splitting machine according to claim 1 wherein said laterally extending cutting edge of said primary blade is positioned to lead the cutting edges of said secondary blades when said blade assembly is advanced so that horizontal splitting of said wood is started before vertical splitting is started.

3. The wood splitting machine according to claim 1 including means for pivotally mounted said secondary blades to said primary blade so said secondary blades can pivot in opposite lateral directions below said primary blade when the secondary blades are cutting through said wood.

4. The wood splitting machine according to claim 1 wherein said primary blade has a plurality of laterally spaced apart longitudinally extending sockets formed therein, said blade having slots on its bottom surface aligned with said openings, respectively, said secondary blades having cylindrical elements formed thereon, said cylindrical elements being disposed in said sockets and said secondary blades extend through said slots with sufficient clearance to allow said blades to swivel laterally on said cylindrical elements during wood splitting.

5. The wood splitting machine according to any one of claims 1, 2, 3 or 4 wherein said laterally extending splitting edge of said primary blade has a sharp edge and is beveled away from said sharp edge at an angle that results in a downward force being exerted on the wood when said primary blade edge progresses into said wood.

6. The wood splitting machine according to claim 5 wherein:

said plate means of said carriage has a leading end remote from said blade assembly and a trailing end proximate to said blade assembly, and including pivot means supporting said top plate means for tilting downwardly on said carriage about a laterally extending axis adjacent said leading end under the influence of said primary blade progressing through said wood, and spring means interposed between said carriage and the bottom of said top plate means for limiting the tilt of said plate means and for restoring said plate means to an untilted condition.

7. The wood splitting machine according to claim 1 wherein said motive means are hydraulic actuator means connected to said support members for advancing and retracting said members.

8. A method of splitting wood blocks comprising the steps of:

disposing one or more wood blocks on a horizontal carriage such that the block or blocks are between a fixed stop positioned above the plane of the carriage and the blade assembly including a horizontal blade whose cutting edge faces said wood and a plurality of vertical blades whose cutting edges face said wood, next advancing said blades through the wood to split and suspend the wood while concurrently shifting the carriage plate out from under the wood so the wood can drop down when it is split, and then retracting said carriage plate and blade assembly together.

* * * * *